United States Patent [19]

Nobinger

[11] 3,981,173

[45] Sept. 21, 1976

[54] APPARATUS FOR BENDING CONDUITS

[76] Inventor: Louis C. Nobinger, 1660 Shannon Road, Bessemer, Ala. 35020

[22] Filed: Aug. 8, 1975

[21] Appl. No.: 603,171

[52] U.S. Cl. ..... 72/389; 72/446; 72/455

[51] Int. Cl.[2] ..... B21D 7/06

[58] Field of Search ..... 72/389, 386, 385, 446, 72/447, 705, 455, 298

[56] References Cited

UNITED STATES PATENTS

| | | | |
|---|---|---|---|
| 2,998,838 | 9/1961 | Byrd | 72/389 |
| 3,385,092 | 5/1968 | Scott | 72/386 |
| 3,429,157 | 2/1969 | Huth | 72/389 |
| 3,446,054 | 5/1969 | Pridy | 72/389 |

*Primary Examiner*—C. W. Lanham
*Assistant Examiner*—Gene P. Crosby
*Attorney, Agent, or Firm*—Woodford R. Thompson, Jr.

[57] ABSTRACT

Conduit bending apparatus embodying a bending unit having a movable shoe spaced from conduit engaging members. The bending unit is pivotally connected to an upstanding member which is carried by an elongated guide. Resilient means holds the upstanding member at selected elevations relative to the guide member. Elongated end members are pivoted to end portions of the guide members and depend therefrom for angular movement to selected positions relative to the guide member. An elongated conduit support member extends between and is pivotally connected to the end members to support a conduit at selected elevations in response to angular movement of the end members.

14 Claims, 5 Drawing Figures

APPARATUS FOR BENDING CONDUITS

BACKGROUND OF THE INVENTION

This invention relates to apparatus for bending conduits and more particularly to a supporting structure for a conventional bending unit whereby the conduit may be bent while supported at an elevation in easy reach of the operator.

Heretofore in the art to which my invention relates, difficulties have been encountered in bending conduits, such as pipes, conduits for electrical cables and other tubular members due to the fact that it has been the usual practice for the pipe to be bent while the bending unit is laying on a flat surface, such as on a floor or on the ground. While bending tables have been proposed, such apparatus is complicated in structure and are difficult to move from place to place due to the excessive weight of such apparatus. Accordingly, such apparatus must be disassembled before it can be moved to another location.

SUMMARY OF INVENTION

In accordance with my invention, I provide apparatus which is simple of construction, light in weight and one in which the bending operation takes place in easy reach of the operator. In accordance with my invention, I provide counterbalanced apparatus which can be easily and accurately set to a convenient height to suite the operator so that the bender is suspended in position to be easily accessible for loading and removing materials, changing sizes, measuring bend angles and lengths and the like. Also, my improved apparatus permits a length of conduit of the same size and length as the one being bent to be mounted in the apparatus to counterbalance the pipe being bent and further to ease the strain of handling a heavy bending unit. Furthermore, if the pipe used as a counterbalance has been bent and the bend is being duplicated, the conduit being bent can be aligned with the previously bent conduit for comparison while it is still in the bending apparatus.

The bending unit is pivotally connected to an upstanding member which is carried by an elongated guide and adapted for longitudinal and vertical movement relative to the guide. Means operatively connects the upstanding member to the guide whereby the upstanding member and the bending unit carried thereby are retained at selected elevations. Elongated end members are pivoted to end portions of the guide member and depend therefrom for angular movement to selected positions to thus provide with a horizontal conduit supporting bar a parallelogram which can be pivoted whereby the horizontal conduit supporting bar carried thereby can be moved toward and away from the bending unit with a minimum of effort.

DESCRIPTION OF THE DRAWINGS

Apparatus embodying features of my invention is illustrated in the accompanying drawings, forming a part of this application, in which.

DETAILED DESCRIPTION

Figure 1:
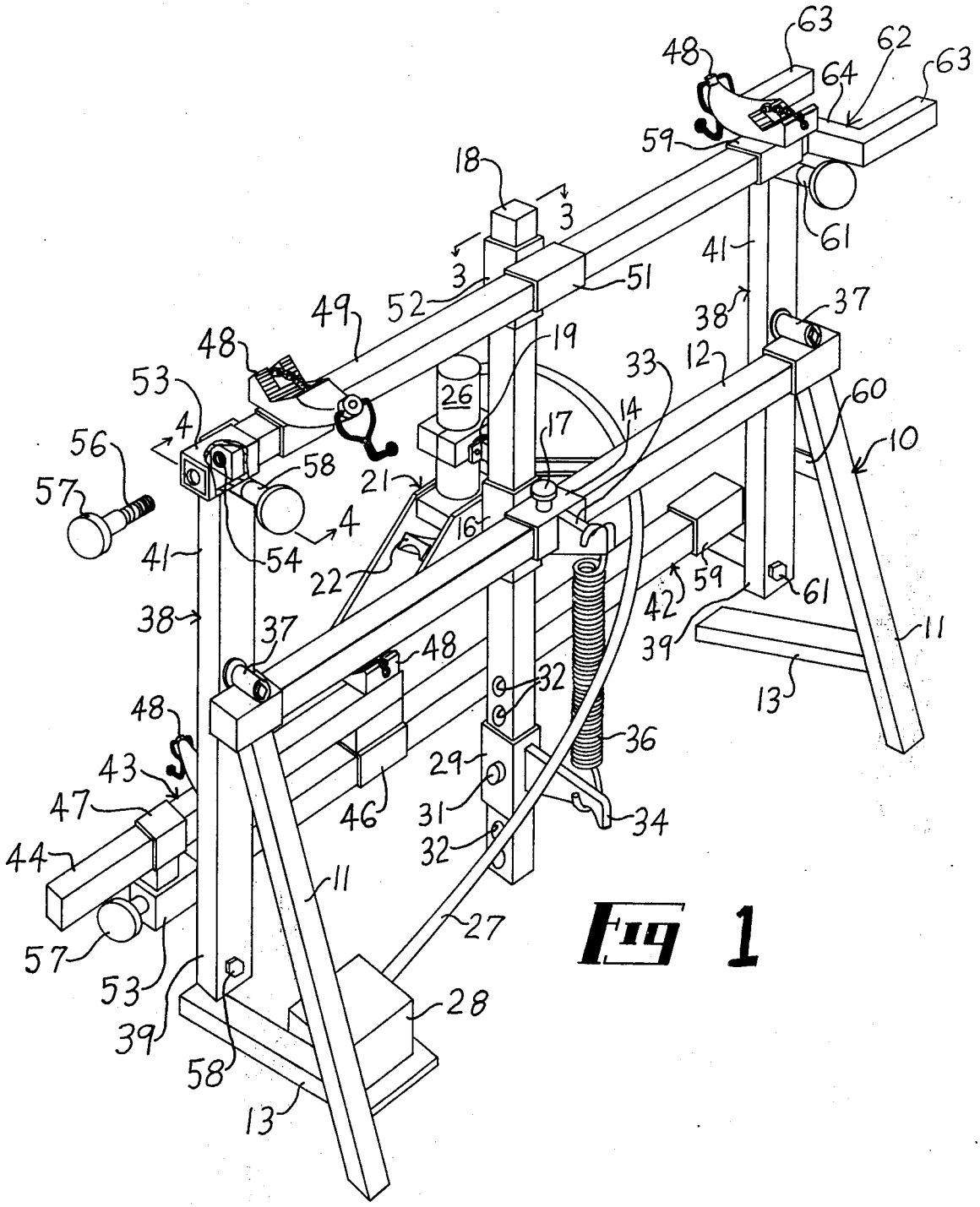
FIG. 1 is a perspective view, partly broken away and parts removed, for the sake of clarity.

Referring now to the drawings for a better understanding of my invention, I show a supporting frame 10 which may comprise inclined support members 11 connected at their upper ends to a horizontal guide member 12, as shown in FIG. 1. Diagonal foot members 13 are secured rigidly to the inclined members 11 whereby the supporting frame 10 is supported in an upright position, as shown in FIG. 1.

Figure 2:
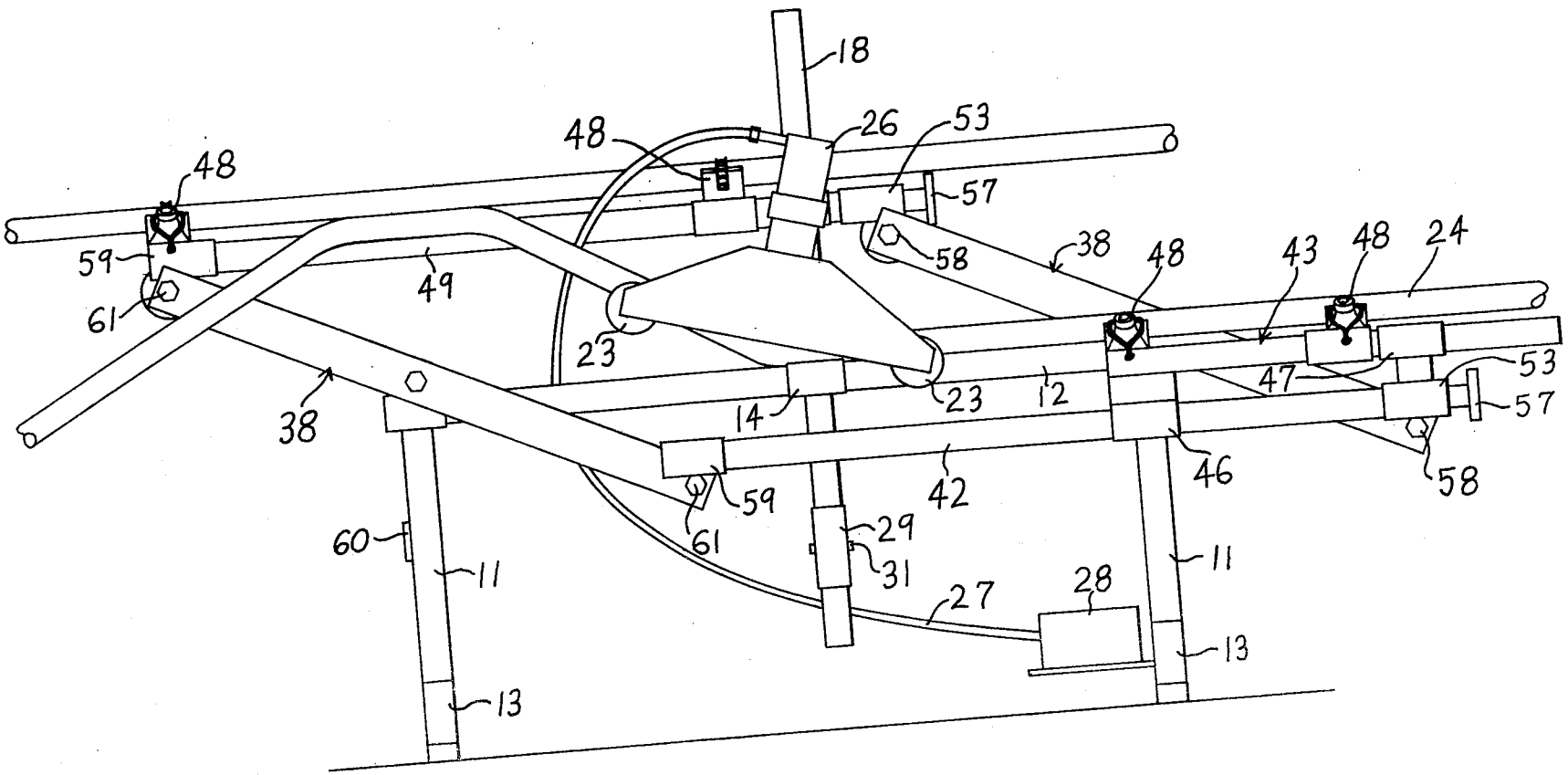
FIG. 2 is a side elevational view showing the opposite side of the apparatus from that shown in FIG. 1 and showing the apparatus mounted on an inclined supporting surface.
Figure 3:
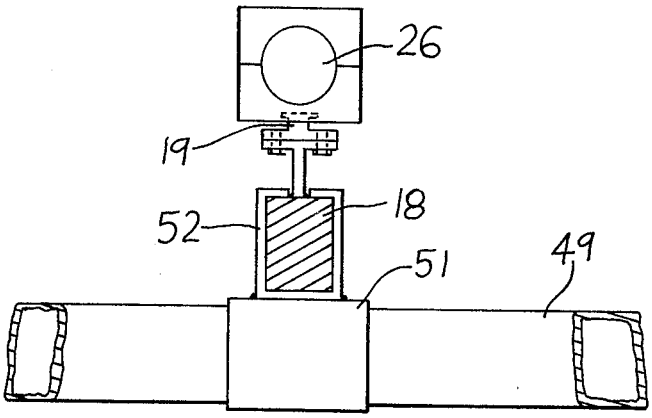
FIG. 3 is an enlarged, fragmental, sectional view taken generally along the line 3—3 of FIG. 1.
Figure 4:
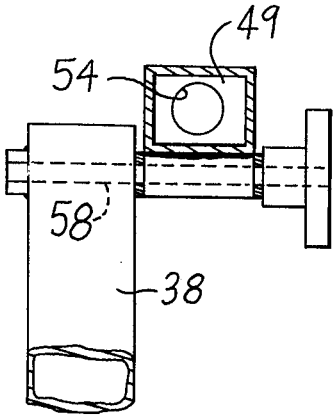
FIG. 4 is an enlarged, fragmental sectional view taken generally along the line 4—4 of FIG. 1; and, FIG. 5 is a side elevational view showing the apparatus mounted on supporting wheels with the bending unit locked in position adjacent one end of the frame for storage and shipment.

Mounted for sliding movement along the guide member 12 is a horizontal sleeve-like member 14 which in turn is secured rigidly to a vertical sleeve member 16. The horizontal sleeve 14 may be secured at selected positions along the guide member 12 by a conventional friction lock member 17. Mounted for vertical sliding movement in the vertical sleeve 16 is an upstanding member 18 which is pivotally connected as at 19 to a conventional conduit bending unit indicated generally at 21. Accordingly, the bending unit 21 is adapted for pivotal movement alongside the guide member 12 and about an axis which is generally perpendicular to the guide member 12. Since the bending unit 21 is carried by the upstanding member 18 it moves therewith whereby it is adapted for vertical movement relative to guide member 12. The bending unit 21 comprises the usual movable bending shoe 22 which is spaced from conduit engaging members 23 for receiving a conduit 24 therebetween, as shown in FIG. 2. The bending shoe 22 is moved toward and away from the conduit engaging members 23 by the usual fluid pressure operated cylinder 26, with the fluid being supplied thereto under pressure by a suitable conduit 27. A suitable control unit 28 may be provided for controlling the flow of fluid under pressure to the fluid pressure operated cylinder 26 in a manner well understood in the art to which my invention relates.

As shown in FIG. 1, a movable sleeve 29 is carried by the lower portion of the upstanding member 18 and is detachably connected to the upstanding member 18 by a suitable pin 31 which passes through a selected opening 32 provided through the upstanding member 18. That is, an aligned row of spaced apart openings 32 are provided in the upstanding member 18 for receiving the pin 31 whereby the sleeve 29 may be supported at selected elevations. Laterally projecting spring engaging brackets 33 and 34 are carried by the sleeves 14 and 29, respectively, for engaging opposite ends of a tension spring 36 which urges the upstanding member 18 upwardly to counterbalance the weight of the bending unit 21 and at the same time position the bending unit at the proper elevation for the bending operation.

Pivotally connected to opposite ends of the elongated guide member 12 by suitable hinge members 37 are elongated end members 38 with each having a lower depending portion 39 and an upstanding portion 41. The end members 38 are adapted for angular movement to selected positions relative to the guide member 12. As shown in FIG. 1, an elongated conduit supporting member 42 extends between the lower ends of the end members 38 and is pivotally connected thereto so that a conduit supported thereby moves to selected elevations in response to angular movement of the end members 38.

As shown in FIGS. 1 and 2, a vise unit 43 is mounted on and forms a part of the conduit supporting member 42. The vise unit 43 comprises an elongated member 44 which carries a sleeve member 46 adjacent one end thereof which slidably engages the elongated support member 42. Also, a sleeve 47 is carried by the end of the elongated member 42 for slidably receiving the elongated member 44 whereby the vise unit 43 is adapted for free, longitudinal movement relative to the elongated member 42. Conventional vise elements 48 are carried by the vise unit 43 whereby the conduit 24 may be clamped by the vise elements and move therewith.

As shown in FIGS. 1 and 2, an elongated, upper member 49 is pivotally connected adjacent opposite ends thereof to the upper ends of the end members 38 whereby the elongated members 42 and 49 and the end members 38 define a parallelogram arrangement wherein the elongated members 42 and 49 move toward and away from each other and at the same time maintain parallel relationship relative to each other. Vise elements 48 are also carried by the elongated upper member 49 whereby a length of pipe may be clamped in place and supported by the upper member 49. Mounted for sliding movement along the upper member 49 is a sleeve 51 which in turn is secured rigidly to a vertical sleeve 52 that receives the upper end of the upstanding member 18 with a sliding fit. Accordingly, the upstanding member 18 is adapted for both vertical and horizontal movement relative to the elongated upper member 49 as well as the guide member 12, as described hereinabove.

To true the apparatus whereby the elongated members 42 and 49 extend at right angles to the end members 38 while the end members 38 are in a true vertical position, I provide a box-like end member 53 which telescopes over one end of each of the elongated members 42 and 49, as shown in FIG. 1. A threaded opening 54 is provided in the end of the elongated members 42 and 49 for receiving the threads 56 of a rotatable member 57 whereby the box members 53 may be moved relative to the adjacent ends of the elongated members 42 and 49. The box members 53 are pivotally connected to the adjacent ends of the elongated members 42 and 49 by suitable hinge pins 58. The opposite ends of the elongated members 42 and 49 also carry box-like members 59 which are pivotally connected to the adjacent end member 38 by pivot pins 61. As shown in FIG. 1, the uppermost pins 58 and 61 may be provided with suitable knobs for rotating the same whereby they provide friction locks for securing the ends of the elongated upper member 49 to the adjacent end members 38 to thereby lock the frame in selected positions. That is, the upper members 58 and 61 provide a friction lock for holding the adjacent units at selected positions relative to each other.

As shown in FIG. 1, a lateral stop 60 is carried by the inclined frame member 10 in position to engage the adjacent depending portion 39 of an end member 38 to thus limit angular movement of the depending portion 39 in a counterclockwise direction, as viewed in FIG. 1.

From the foregoing description, the operation of my improved apparatus will be readily understood. A conduit 24 to be bent is positioned between the bending shoe 22 and the conduit engaging members 23 and is clamped in place by the vise elements 48 carried by the vise unit 43. To counterbalance the weight of this conduit, a second conduit 24 of the same weight may be clamped in place in the upper vise elements 48 carried by the elongated member 49 whereby the apparatus is counterbalanced for easy operation by the operator. The tension spring 36 counterbalances the weight of the bending unit 21 to further facilitate operation of the apparatus. The conduit 24 to be bent is inserted through the bending unit 21 by passing the same between the shoe 22 and the conduit engaging members 23 or by removing the conduit engaging members 23 and then moving the pipe upwardly adjacent the bending shoe 22. The conduit engaging members 23 are then reinstalled. It will be understood that the conduit engaging members 23 are held in place by removable pins. The pipe 24 is moved upwardly toward the bending shoe 22 by moving the parallelogram frame whereby the pipe supporting member 42 moves upwardly. To bend the pipe, fluid under pressure is introduced through the conduit 27 to the fluid pressure operated cylinder 26 whereby the shoe 22 moves downwardly to thus impart any desired bend in the conduit. A suitable protractor may be mounted on the bending unit 21 or on another convenient part of the apparatus to indicate the exact bend made in the pipe.

To form a lateral bend in the pipe from the first bend made therein, the bending shoe 22 is retracted and the pipe is rotated 90° and the second bend is thus made therein. To make a bend opposite the first bend, the pipe is merely rotated 180° whereby a reverse bend may be made without removing the conduit from the apparatus. Where it is desired to use a previously bent pipe as a pattern, the previously bent pipe is clamped in place by the upper vise elements 48 carried by the upper elongated member 49. As the bend is imparted to the lower pipe clamped in place by the vise elements 48 carried by the elongated pipe supporting member 42, the bends in the adjacent pipes may be compared with each other. That is, the parallelogram arrangement permits the elongated members 42 and 49 to move to a position adjacent and alongside each other whereby a direct comparison may be made between the pipe being bent and the pipe previously bent.

As shown in FIG. 1, a U-shaped frame member 62 is connected to one end of the elongated, upper member 49 whereby the parallel legs of the U-shaped member project outwardly in a direction generally parallel to the elongated member 49. The base portion 64 of the U-shaped member is secured to the adjacent end of the elongated member 49. If desired, the U-shaped member may be detachably connected to the elongated member 49 by providing an extension on the base portion 64 which telescopes into a recess in the elongated member 49. The U-shaped member 62 thus serves as a support for a conventional type drive device, such as a pipe threader or cutter whereby a length of pipe may be cut or threaded in the conventional manner. A conventional portable threader or cutter unit is mounted on the pipe in the usual manner and rotary motion is imparted to the threader or cutter while the portable unit is supported by the U-shaped bracket 62 to thus facilitate threading or cutting conduits. That is, the legs 63 engage the portable unit to prevent the portable unit from rotating about its own output so that torque is transmitted to the threader, cutter or other driven device.

Figure 5:
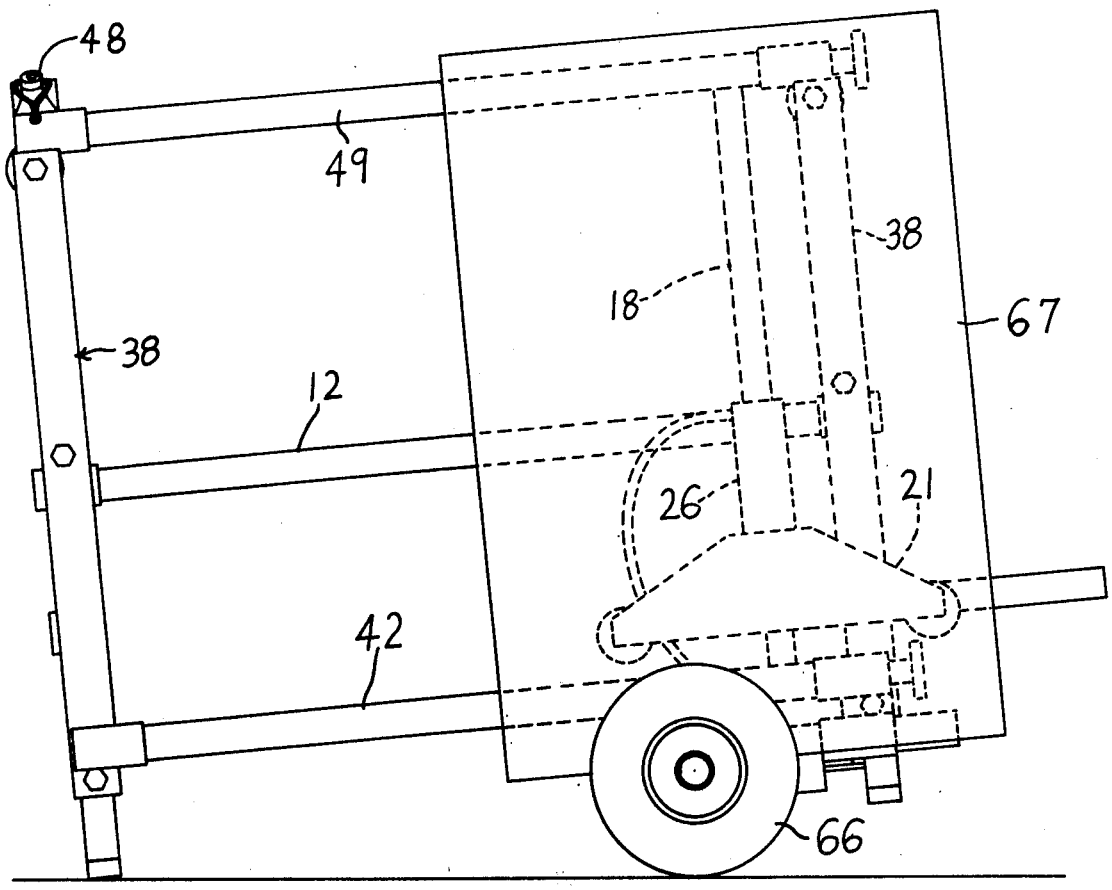

As shown in FIG. 5, my improved apparatus may be mounted on wheels 66 whereby the apparatus may be moved from place to place with a minimum of effort. To facilitate movement of the apparatus on the supporting wheels 66, the bending unit 21 is shifted along the guide member 12 to the position shown in FIG. 5 whereby the bender unit 21 is above and adjacent the supporting wheels 66 to thus counterbalance the other end of the apparatus. The upstanding member 18 and the bending unit 21 are then locked in place by means of the friction lock 17 to thus retain the apparatus in the position shown in FIG. 5. A suitable cover indicated generally at 67 may be placed over the apparatus during transfer of the apparatus from one place to another or during storage to prevent theft of the bender unit or any of its parts. The entire unit could thus be chained to a stationary structure overnight, thus eliminating the necessity of disassembly and the storage of parts in a gang box or the like.

From the foregoing description, it will be seen that I have devised improved apparatus for bending conduit. By providing apparatus which is portable and which is provided with means for counterbalancing the pipe being bent, the operator does not have to manually force the conduit into working position whereby the operator can concentrate on making an accurate bend with a minimum of effort. Also, by providing apparatus which permits forming bends lateral to the original bend placed in the pipe as well as bends reversed to the direction of the bend originally placed in the pipe, such bends may be made in the pipe without actually removing the pipe from the bending apparatus. Furthermore, by duplicating the bend already made in a previously bent pipe by merely placing the previously bent pipe in the upper vise elements carried by the upper member 49 and then bending the lower pipe to a shape corresponding to the upper bent pipe, the bends are made accurately, with a minimum of effort and without having to remove the pipe being bent from the apparatus. In actual practice, I have found that my improved apparatus is adapted for making off-set bends in pipes whereby two parallel sections of the pipe are spaced a predetermined distance from each other. Also, the parallelogram frame may be pre-set and locked in place before bending. Furthermore, my apparatus is adapted for operation on uneven or sloped surfaces as well as on a flat or level surface.

While I have shown my invention in but one form, it will be obvious to those skilled in the art that it is not so limited but is susceptible of various changes and modifications without departing from the spirit thereof.

What I claim is:

1. In apparatus for bending conduits with a bending unit embodying a movable bending shoe spaced from conduit engaging members for receiving a conduit therebetween with means to impart relative movement between said bending shoe and said conduit engaging members whereby the conduit is bent, a. a supporting frame having a generally horizontal guide member, b. an upstanding member carried by said guide member intermediate the ends of said guide member and adapted for vertical and longitudinal movement relative to said guide member, c. means pivotally connecting said bending unit to said upstanding member so that the bending unit moves with said upstanding member, d. means retaining said upstanding member at selected elevations relative to said guide member, e. an elongated end member mounted for pivotal movement adjacent each end of said guide member and having a depending portion adapted for angular movement to selected positions relative to said guide member, and f. an elongated conduit supporting member extending between said end members and pivotally connected thereto so that a conduit supported thereby moves to selected elevations in response to angular movement of said end members.

2. Apparatus as defined in claim 1 in which at least one vise unit for clamping a conduit is carried by said conduit supporting member and is adapted for longitudinal movement relative to said conduit supporting member.

3. Apparatus as defined in claim 1 in which means is provided for holding said elongated conduit supporting member at selected angular positions relative to said elongated end members whereby said elongated conduit supporting member may be locked at right angles relative to said end members while said end members are in a vertical position.

4. Apparatus as defined in claim 1 in which a stop member is carried by said supporting frame in position to engage one of said elongated end members to limit angular movement thereof.

5. Apparatus as defined in claim 1 in which releasable means is provided to attach said upstanding member to said guide member whereby said bending unit may be locked in place at selected positions along said guide member.

6. Apparatus as defined in claim 1 in which said upstanding member is mounted for sliding movement in a vertical sleeve-like member which is carried by a horizontal sleeve-like member mounted for sliding movement along said guide member.

7. Apparatus as defined in claim 6 in which spring means is interposed between said upstanding member and said horizontal sleeve-like member to retain said bending unit at a predetermined elevation relative to said guide member.

8. Apparatus as defined in claim 7 in which said spring means is connected to said upstanding member at selected elevations so that said bending unit is supported at selected elevations.

9. Apparatus as defined in claim 1 in which each said elongated end member is pivotally connected to said guide member intermediate the ends of said end member to provide an upstanding portion above the pivotal connection to said guide member and an elongated upper member extends between and is pivotally connected to said upstanding portions.

10. Apparatus as defined in claim 9 in which said elongated upper member is operatively connected to said upstanding member by a horizontal sleeve which slidably engages said elongated upper member and a vertical sleeve which is secured to said horizontal sleeve and slidably engages said upstanding member.

11. Apparatus as defined in claim 9 in which at least one vise unit for clamping a conduit is carried by said elongated upper member.

12. Apparatus as defined in claim 11 in which the base of a generally U-shaped member is connected to one end of said elongated upper member with the legs of said U-shaped member extending outwardly in a direction parallel to said elongated upper member.

13. Apparatus as defined in claim 1 in which releasable means is provided to restrain relative movement between said elongated end members and said elongated conduit supporting member to hold said elongated conduit supporting member at selected elevations.

14. Apparatus as defined in claim 13 in which said releasable means is a friction lock.

* * * * *